US005823766A

United States Patent [19]

Seiler et al.

[11] Patent Number: 5,823,766

[45] Date of Patent: Oct. 20, 1998

[54] FURNACE INSTALLATION AS INTERMEDIATE STORAGE DOWNSTREAM OF A THIN-SLAB CASTING INSTALLATION

[75] Inventors: Peter Wilhelm Seiler, Oberhausen; Stanislaw Pawlowski; Eugeniusz Kania, both of Mülheim/Ruhr; Horst Wolfgang Mathejka, Dortmund; Werner Kircher, Ratingen, all of Germany

[73] Assignee: Mannesmann Aktiengesellschaft, Düsseldorf, Germany

[21] Appl. No.: 529,168

[22] Filed: Sep. 12, 1995

[30] Foreign Application Priority Data

Sep. 15, 1994 [DE] Germany ..... 44 34 370.1

[51] Int. Cl.[6] ..... F27B 9/00

[52] U.S. Cl. ..... 432/121; 432/128; 432/239

[58] Field of Search ..... 432/121, 128, 432/239; 72/202; 29/527.7

[56] References Cited

U.S. PATENT DOCUMENTS 4,698,897 10/1987 Frommann et al. ..... 72/202

4,976,024 12/1990 Kimura ..... 29/527.7

*Primary Examiner*—Noah P. Kamen

*Attorney, Agent, or Firm*—Cohen, Pontani, Lieberman, Pavane

[57] ABSTRACT

A furnace installation as an intermediate storage between a mandrel-free coiling mechanism for strip-shaped cast billet, which is arranged downstream of a thin slab casting installation, and an uncoiling mechanism communicating with a downstream rolling mill, and a system for transporting the coiled bundles through the furnace installation. The furnace installation includes an integral coiling mechanism on the charging side. At least one transporting device for transporting the bundles is provided outside and below the furnace installation and is movable along the furnace installation. The transporting device penetrates into the furnace installation by lifting/lowering supports for the bundle to be transported. The uncoiling mechanism is likewise integrated in the furnace installation at a distance from the coiling mechanism which allows a plurality of bundles arranged adjacent to one another to be picked up. The uncoiling mechanism communicates with the coiling mechanism via the transporting device.

11 Claims, 4 Drawing Sheets

FURNACE INSTALLATION AS INTERMEDIATE STORAGE DOWNSTREAM OF A THIN-SLAB CASTING INSTALLATION

BACKGROUND OF THE INVENTION

FIELD OF THE INVENTION

The invention is directed to a furnace installation for storage and transportation of coiled bundles. An intermediate storage chamber is located between a mandrel free coiling mechanism and an uncoiling mechanism. Strip-shaped cast billets are fed to the coiling mechanism from a thin-slab casting installation. The uncoiling mechanism is arranged to deliver the billets to a downstream rolling mill.

DISCUSSION OF THE PRIOR ART

A furnace installation of the generic type is known from German Patent 32 41 745, in particular from FIG. 2 of this reference. As is described in this reference, the problem with installations in which the continuous-cast thin slab is fed directly to a downstream rolling mill is that the pouring or casting rates are, and must be, substantially lower than the rolling rates in the rolling mill. Therefore, various solutions have been proposed for effecting a balance of speeds, e.g., by intermediate storage of the coiled strip-shaped cast billet in a furnace installation. This is a simple way of creating a buffer zone between the continuous casting installation and the rolling mill.

In a furnace installation of this kind, which is outlined only in a roughly schematic manner in the prior art, it has turned out that a number of problems and difficulties occur substantially as a result of the complexity of the arrangements employed and due to insufficient thermal balances. While the complexity of the system is a question of costs and, consequently, a question of the economic efficiency of the system when considering downtime caused by breakdowns or repairs, the thermal balance is a direct determinant to the quality of the preliminary product to be rolled.

SUMMARY OF THE INVENTION

Accordingly, it is an object of the present invention to provide a furnace arrangement in which only small heat losses occur in an extensively closed furnace system. The fewest possible moving elements are used in the interior of the system so as to provide for low heat loss and high operating reliability.

In order to meet this object, the furnace installation of the present invention includes the following features: *a*) A coiling mechanism integrated into the furnace installation on the charging side. *b*) At least one transporting device for transporting the coiled bundles. The transporting device is provided outside and below the furnace installation and is movable along the furnace installation. The transporting device also penetrates into the furnace installation with lifting/lowering supports that support the bundle to be transported. *c*) The uncoiling mechanism is likewise integrated in the furnace installation at a distance from the coiling mechanism. This permits a plurality of bundles arranged adjacent to one another to be picked up. The uncoiling mechanism communicates with the coiling mechanism via the transporting device.

The required self-contained system with low heat losses is produced by integrating the coiling mechanism and uncoiling mechanism in the furnace installation. The transporting device which is arranged below the furnace installation and which has moving parts provided outside the furnace installation appreciably reduces the susceptibility to breakdown of those parts which would otherwise be provided within the furnace. This ensures the required operating reliability.

According to a further embodiment of the invention, the transporting device is formed of two bundle transporting cars which are movable independently from one another on running rails extending centrally and longitudinally below the furnace installation. One of the transporting cars is associated with the coiling station while the other transporting car is associated with the uncoiling station. In this way, a dependable intermediate storage system is provided that is outfitted with proven operating components.

According to still another embodiment of the present invention, the supports, which are provided on the transporting cars for holding the bundles, penetrate through an opening in the furnace installation that extends along the bottom parallel to the running rails. Flaps are provided for closing the opening. The flaps can be moved away in the immediate region of the supports while the transporting cars are moving. As was already explained above, the moving parts (transporting cars) are arranged outside the furnace installation and only the lifting/lowering supports penetrate from below into the furnace. The flaps which close the opening in the bottom of the furnace ensure that only an extremely small amount of heat can be discharged in a region where the flaps are moved away in the immediate region of the transporting cars and supports.

Another embodiment of the invention provides that the flaps can be moved away to form a through-opening for descaling. Since scaling always occurs in the interior of the furnace, measures must be taken to ensure that the scale can exit the furnace. For this purpose, the flaps are constructed so that self-cleaning of the furnace can be carried out.

According to another embodiment of the invention, the furnace installation is provided with depositing benches or delivery benches outside the coiling and uncoiling mechanisms on either side of the opening in the bottom. The depositing benches or delivery benches form prismatic supports for the bundles so that the bundles transported from the transporting car into the furnace installation can be deposited on the benches for the purpose of intermediate storage. The bundles are deposited on the delivery benches adjacent to one another in the longitudinal direction of the furnace installation and are intermediately stored in this way. As soon as the uncoiling station is free after uncoiling a bundle, the transporting car associated with the uncoiling station can transfer the intermediately stored bundle to the uncoiling station.

Pursuant to still another embodiment of the invention, the coiling station has driveable bottom rolls arranged within the furnace installation for accepting the strip shaped cast billet arriving from the thin-slab casting installation. Pinch rolls and adjustable bending rolls, which close the furnace inlet opening to a great extent in the operating state, are associated with these bottom rolls in order to form the bundle. Mandrel-free coiling stations of this type are known per se. Such a station is now integrated into the overall furnace installation and the pinch rolls and bending rolls required for producing the bundle are arranged so that they close the furnace in the operating position and accordingly keep heat discharge low.

The pinch rolls and bending rolls can preferably be moved as a unit from the inlet opening of the furnace installation into a repair and/or inspection position. A door is provided for closing the inlet opening of the furnace installation when the pinch rolls and bending rolls are moved out. As a result of this embodiment of the invention, parts which are exposed to wear can be moved out of the overall installation very quickly without the occurrence of heat losses in the furnace, since the opening is immediately closed by the door.

According to yet another embodiment of the invention, the uncoiling station which is integrated into the furnace installation also has driven bottom rolls. The bottom rolls act as a support for the bundle to be uncoiled. A door is also provided which can be opened in the direction of the downstream rolling mill to permit the introduction of a manipulator. The manipulator guides the start of the strip and can be moved back after the start of the strip has been threaded into the pair of pinch rolls. After the strip is threaded into the pinch rolls, the door can be closed to a point where a narrow through-opening is left for the strip-shaped cast billet.

The bottom rolls of the coiling station and the uncoiling station are arranged on a movable frame that can be moved transversely away from the furnace installation on running rails arranged below the system. This enables easy removal of these parts from the furnace for inspection, repair or replacement. All of the devices discussed are provided so that they can be easily moved out of the furnace. Furthermore, the furnace installation can be expanded into a two-lane installation by adding a coiling station and an intermediate storage part.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
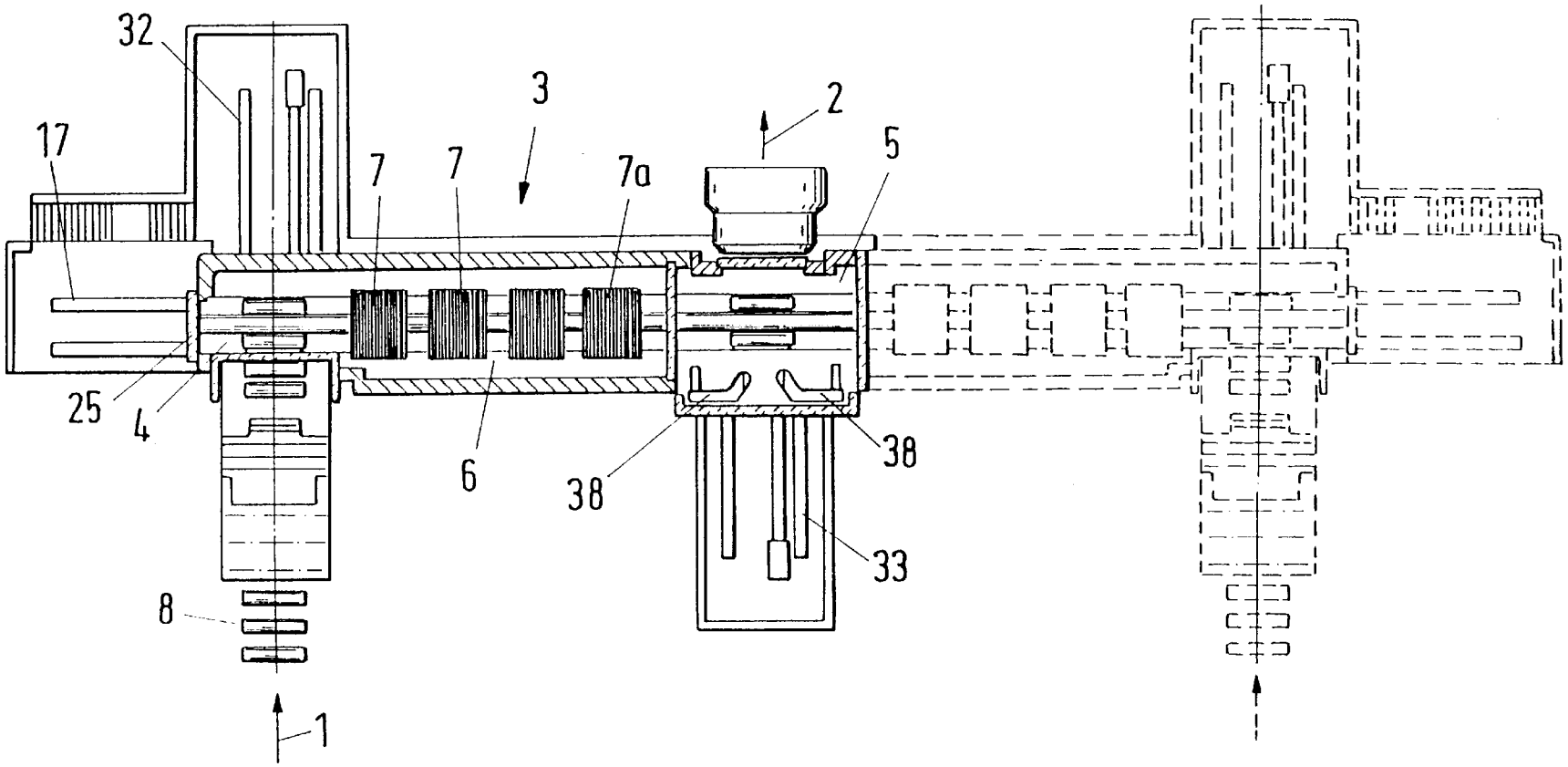
FIG. 1 is a top view of the furnace installation according to the present invention.

As is shown in FIG. 1, the system is arranged in a Z-shaped manner. Arrow 1 indicates the direction of the cast billet coming from the thin-slab casting installation (not shown) and arrow 2 shows the direction in which the uncoiled cast billet is guided to the downstream rolling mill. The furnace installation is designated in its entirety by 3 and substantially comprises a coiling station 4, an uncoiling station 5, and an intermediate storage part 6 arranged therebetween. Coils or bundles 7 are stored next to one another, are shown] in the intermediate storage part 6. Four coils are shown merely as an example since fewer or more coils can also be present. The cast billet can be fed to the furnace installation via a roller table segment 8. Part of an installation arranged in a mirror-inverted manner is shown in dashed lines in the right half of the drawing and is intended to convey that the furnace installation according to the invention is suitable for connecting two thin-slab casting installations arranged parallel to one another and that the installation is capable of being expanded in this way.

Figure 2:
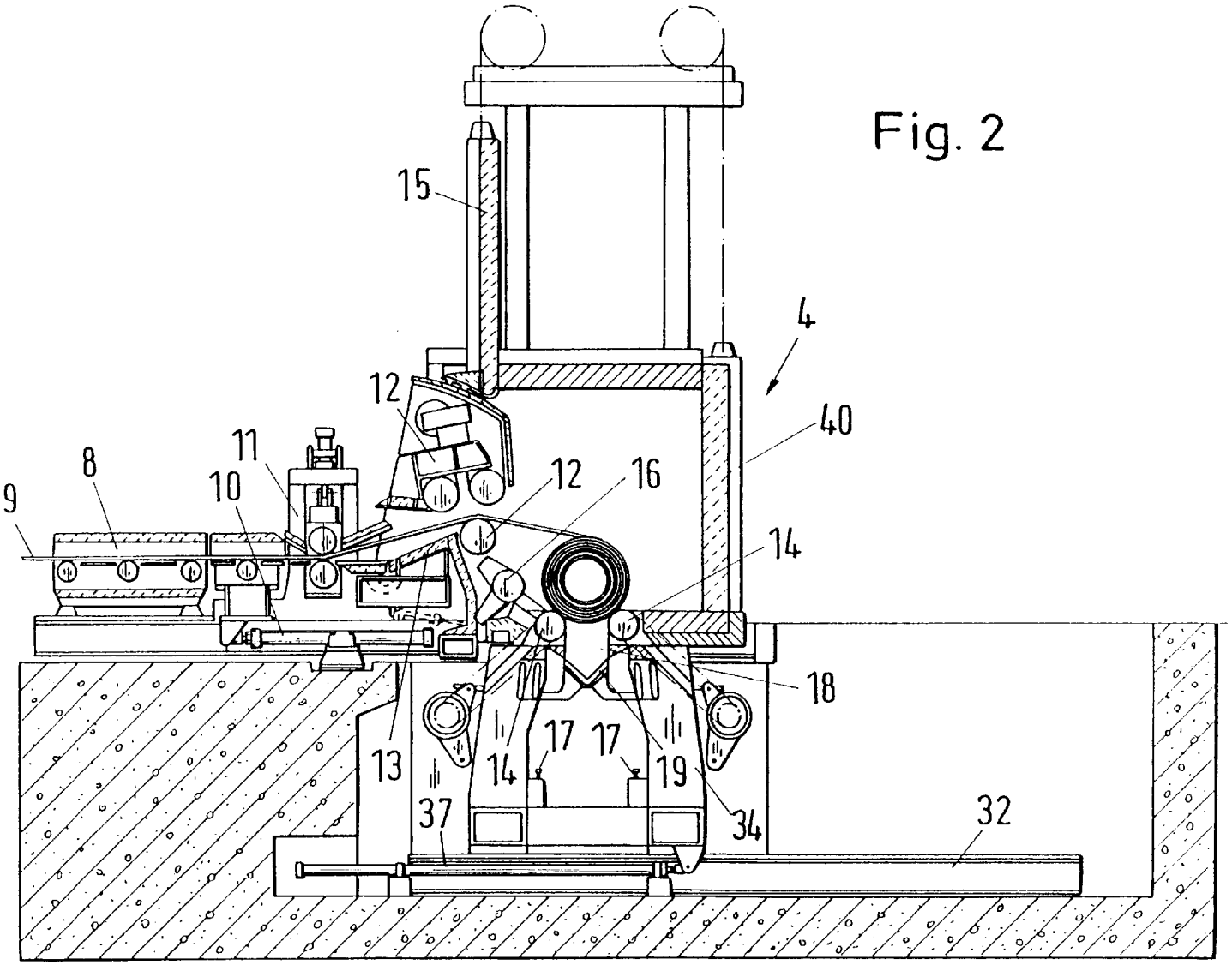
FIG. 2 is a cross-section through the coiling station of the furnace installation.
Figure 3:
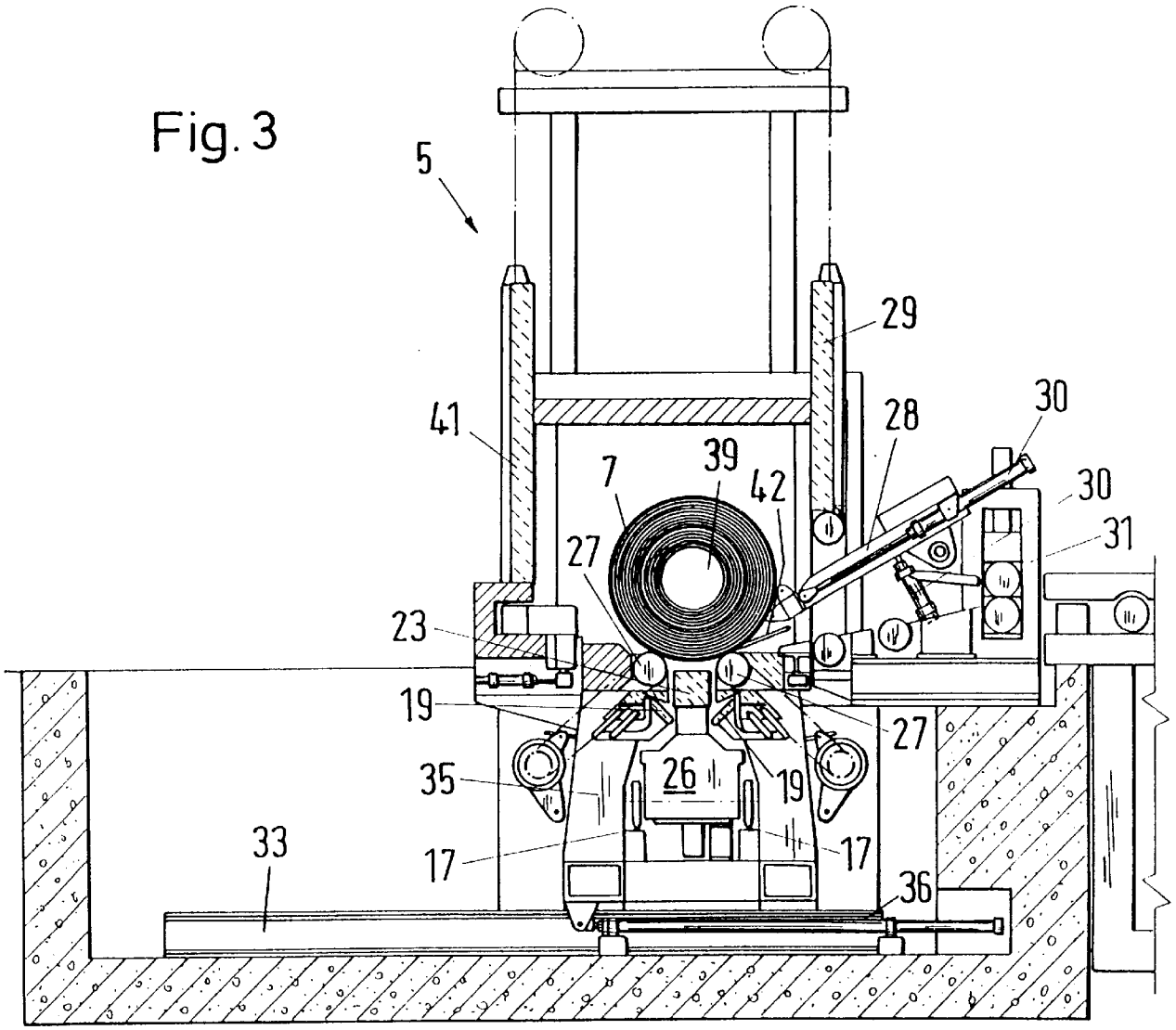
FIG. 3 is a cross-section through the uncoiling station of the furnace installation.

The individual parts of the installation can best be described with reference to FIGS. 2 and 3. In FIG. 2, the roller table segment 8 is enclosed and receives the cast billet 9 coming from the thin-slab casting installation, not shown, with or without intermediate blooming trains. The cast billet 9 is fed to a movable pair of pinch rolls 11. The pinch rolls 11 grasp the billet 9 and feed it to a bending roll unit 12. A roll directing table 13 acts as a guide for the billet 9. The bending rolls of the bending roll unit 12 shape the cast billet into a coil which is rolled into a bundle on driven bottom rolls 14. As will be seen, the bending roll unit 12 and the pinch rolls 11 are screened off to such an extent that only a small through-opening remains for the cast billet 9 to pass through so that the furnace is extensively closed.

The coiling process for the bundle continues and, after an initial coiling phase in which the bundle is supported by movable supporting rolls 16, the driven bottom rolls 14 take over the coiling process to form the finished bundle. The strip coiling speed corresponds to the speed of the thin-slab casting installation or, as the case may be, to the speed of the blooming train. The last windings of the bundle are coiled at a higher speed in order to maintain a difference in time between the transporting away of the bundle from the bottom rolls 14 of the coiling station and the subsequent start of the next cast billet portion. The difference in time is so structured that the finished bundle can be transported away from the coiling station before the start of the next cast billet enters.

For the purpose of inspection and repair, the pinching roll unit 11 and the bending roll unit 12 can be moved in their entirety in the direction of the thin-slab casting installation by a piston-cylinder unit 10, to a position where the units 11, 12 can be separated from the system. The opening created in the furnace installation by moving the units 11, 12 is closed by a door 15 which is positioned above the bending roll unit 12 during operation. Closing the door 15 maintains the temperature of the furnace when the units 11, 12 are removed.

A transporting car, which will be explained in more detail below, is provided for transporting the bundle out of the coiling station . The car can be moved on running rails 17 arranged below the coiling station and below the furnace installation 3. For this purpose, an end 42 of the coiled strip is first brought into a position below the bundle axis and secured in this position. Securing the strip end 42 in this way makes it possible to easily locate and uncoil the bundle, as will be described more fully below. The bundle transporting car lifts the bundle up with a lifting/lowering support that penetrates into an opening 18 in the bottom of the uncoiling station. The car lifts the bundle off the bottom rolls 14 and transports it out of the coiling station 4. When a bundle is not being transported out of the coiling station 4 the bottom of the coiling station 4 and the entire furnace installation 3 are closed by flaps 19. The flaps 19 are opened and closed temporarily and automatically by the transporting car as the car moves with the coil. The length of the furnace installation (FIG. 1) between the coiling mechanism 4 and the uncoiling mechanism 5 is determined on the one hand by the lateral distance between the thin-slab casting installation and the rolling mill train and, on the other hand, by the number of storage places required. During normal operation, the bundles 7 formed in the coiling station 4 are transported by the transporting car directly to the position occupied by bundle 7*a* or directly into the uncoiling station 5 and deposited there.

Figure 4:
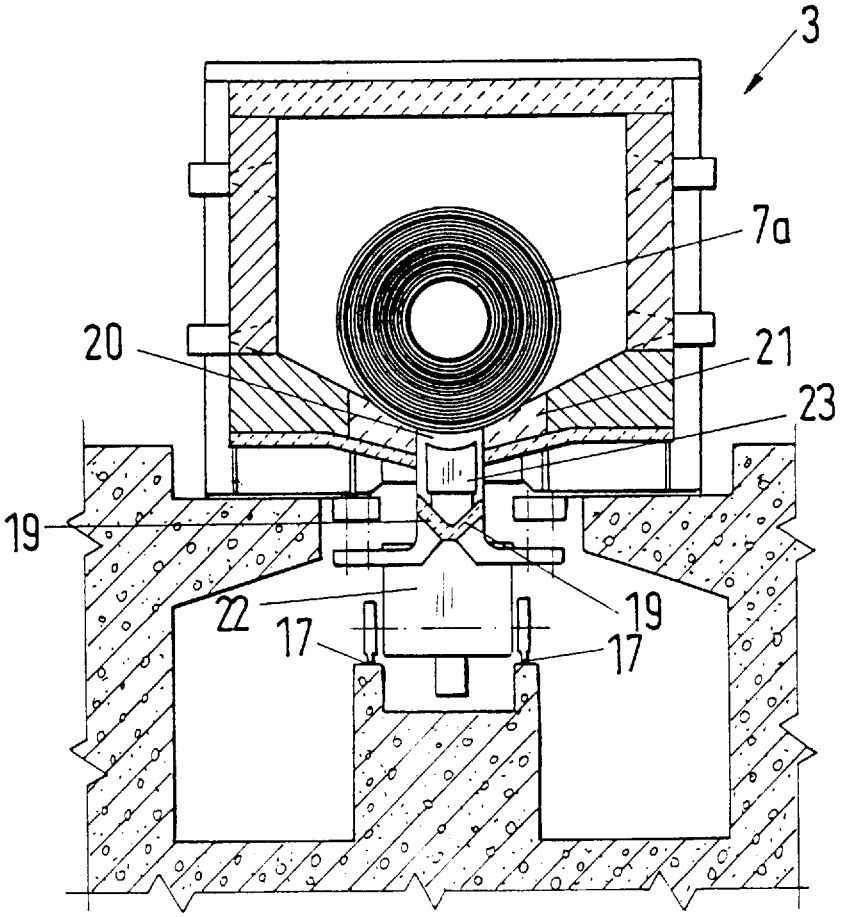
FIG. 4 is a cross-section through the furnace installation.

FIG. 4 shows a cross section through the furnace installation 3 in the region where the bundle 7*a* is deposited. It will also be seen from this drawing that the furnace installation 3 is provided with delivery benches 21 on both sides of the bottom opening 20. The bundles rest on the delivery benches 21. These delivery benches 21 are preferably formed of a material with low thermal conductivity. FIG. 4 also shows the transporting car 22 which has transported the bundle 7 or 7*a* out of the coiling station 4 into the shown storage position using the lifting/lowering support 23. The transporting car 22 has wheels 24 that ride on the rails so that the car can be driven along the furnace installation 3. It can be seen from FIG. 4, that the bottom opening 20 is closed by the flaps 19 directly in front of and behind the transporting car 22.

In the event of a disturbance in the rolling mill train, the additional storage places for bundles 7 within the furnace installation 3 can also be occupied. It is also possible, as is indicated in FIG. 1, to provide a front door 25 in the furnace installation 3 through which a bundle can be moved out of and into the system. It is also possible to thread the bundles 7 in and out through doors 40, 41 of the furnace via a frame construction 34 and 35 of the bottom rolls 14 and 27.

The bundle transported out of the coiling station during normal operation is moved by the transporting car 22 either directly into the uncoiling station 5 or into position 7*a*. The bundle is then taken over by a second transporting car 26 associated with the uncoiling station 5 after the bundle is deposited on the delivery benches 21. The second transporting car 26 is substantially identical in construction to the transporting car 22 associated with the coiling station and is independently movable on the rails 17. It can be seen, from the cross section through the uncoiling station shown in FIG. 3, that the second transporting car 26 has a lifting/lowering support 23 that penetrates through the opening formed between the bottom rolls 27 of the uncoiling station and lifts the bundle 7 when the flaps 19 are open. The transporting car 26 accordingly deposits the bundle 7 on the bottom rolls 27 after lowering the support 23. In this respect, the prepositioning of the start of the bundle below the axis of the bundle turns out to be useful in that it enables the bundle opener 28 to move in via pressure-medium operation 30 after the door 29 is opened and to guide the start of the bundle to the pinch rolls 31. At the same time, the driven bottom rolls 27 start uncoiling the bundle 7. As soon as the pinch rolls 31 have grasped the start of the bundle 7, the door 29 of the furnace installation is closed to a point leaving only a small gap that allows the cast billet 9 to pass through. The door 29 remains in this position until the bundle has been completely uncoiled. It is be possible to swivel bundle holders 38 into the eye 39 of the bundle 7 toward the end of the uncoiling process in order to prevent the bundle from lifting off the bottom rolls. The bundle holders 38 are shown in FIG. 1. FIG. 1 also shows the running rails 32 and 33 which extend transversely to the furnace installation 3 and enable the bottom rolls of the uncoiling station and coiling station to move out of the process line. For this purpose, the bottom rolls 14 or 27 are arranged on the frame construction 34 or 35. The frame construction 34, 35 can be moved out of the furnace installation 3 on the rails 32, 33 by means of cylinders 36 and 37. If necessary, it is possible to move out the second transporting car 26 together with the frame 35 for inspection and repair reasons. The frames 34, 35 are constructed so that the large amount of scale which occurs during operation can be guided off easily, especially when uncoiling the bundle.

The invention is not limited by the embodiments described above which are presented as examples only but can be modified in various ways within the scope of protection defined by the appended patent claims.

I claim:

1. A furnace installation, comprising:

mandrel-free coiling means for coiling strip-shaped cast billet into bundles, said coiling means being arranged at a charging end of the furnace installation;

uncoiling means downstream of the coiling means for uncoiling the bundles;

means for transporting the coiled bundles from the coiling means to be uncoiling means, the transporting means include at least one transporting device that is movable between the coiling means and the uncoiling means, the transporting means further including lifting/lowering supports mounted on the transporting device for lifting and lowering the bundles, the uncoiling means being provided at a distance from the coiling means sufficient to permit a plurality of bundles to be arranged adjacent one another between the coiling means and the uncoiling means, the transporting means including running rails arranged to extend centrally below a bottom of the furnace installation and longitudinally thereto, the transporting means further including two bundle transporting cars arranged to be movable independently from one another on the running rails, a first one of the transporting cars being operative with the coiling means and a second one of the transporting cars being operative with the uncoiling means;

a bottom having an opening that extends parallel to the running rails, the supports being provided on the transporting car so as to penetrate through the opening in the bottom; and, flaps pivotably arranged to open and close the opening, the flaps being moveable in an immediate region of the supports during movement of the transporting cars.

2.a furnace installation according to claim 1, wherein the flaps are provided to be movable into an open position which creates a through-opening through which scaling can be undertaken.

3. A furnace installation according to claim 1, and further comprising delivery benches provided on either side of the opening on the bottom and outside the coiling means and uncoiling means so as to form prismatic supports for the bundles.

4. A furnace installation according to claim 1, wherein the transporting means is operative to bring an end of the bundle of strip-shaped cast billet into a defined position below an axis of the bundle, the strip end being securable in this position.

5. A furnace installation according to claim 1, wherein the coiling means, the uncoiling means and the transporting means are all provided so as to be disconnectable form one another.

6. A furnace installation according to claim 1, and further comprising additional coiling means and additional transporting means for transporting coiled bundles from the additional coiling means to the uncoiling means, the additional coiling means, the transporting means, the additional transporting means and the uncoiling means being arranged to form a two-lane installation.

7. A furnace installation, comprising:

mandrel-free coiling means for coiling strip-shaped cast billet into bundles, said coiling means being arranged at a charging end of the furnace installation;

uncoiling means downstream of the coiling means for uncoiling the bundles;

means for transporting the coiled bundles from the coiling means to the uncoiling means, the transporting means including at least one transporting means further including lifting/lowering supports mounted on the transporting device for lifting and lowering the bundles, the uncoiling means being provided at a distance form the coiling means sufficient to permit a plurality of bundles to be arranged adjacent one another between the coiling means and the uncoiling means; and , an inlet having an opening, the coiling means including the drivable bottom rolls arranged to receive the strip-shaped cast billet from a thin-slab casting installation, the coiling means further including pinch rolls and adjustable bending rolls arranged to close the inlet opening to a great extent in an operating state, the pinch rolls and the adjustable bending rolls being associated with the bottom rolls to facilitate formation of the bundles.

8. A furnace installation according to claim 1, wherein the pinch rolls and the bending rolls are arranged to be moveable as a unit from the inlet opening into a repair and installation position, and further comprising doors means for closing the inlet opening when the pinch rolls and bending rolls are moved out.

9. A furnace installation according to claim 1, and further comprising running rails arranged beneath the coiling means and transverse to a transporting direction of the coiled bundles by the transporting means, and still further comprising a moveable frame mounted on the running rails so as to be moveable toward and away from the coiling means, the bottom rolls of the coiling means being mounted on the moveable frame.

10. A furnace installation, comprising:

mandrel-free coiling means for coiling strip-shaped cast billet into bundles, said coiling means being arranged at a charging end of the furnace installation;

uncoiling means downstream of the coiling means for uncoiling the bundles; and means for transporting the coiled bundles from the coiling means to be uncoiling means, the transporting means including at least one transporting device that is moveable between the coiling means and the uncoiling means, the transporting means further including lifting/lowering supports mounted on the transporting device for lifting and lowering the bundles, the uncoiling means being provided at a distance form the coiling means sufficient to permit a plurality of bundles to be arranged adjacent one another between the coiling means and the uncoiling means, the uncoiling means including driven bottom rolls for the bundle to be uncoiled, a door which is openable in a downstream direction, pinch rolls arranged outside the door and manipulator means which can introduced into the door opening for guiding a start of the bundle into the pinch rolls, the manipulator means being moveable out of the door opening after the start of the bundles is threaded into the pinch rolls, the door being closable up to point which defines a narrow through-opening for the strip-shaped cast billet.

11. A furnace installation according to claim 10, and further comprising running rails arranged beneath the uncoiling means and transverse to a transporting direction of the coiled bundles by the transporting means, and still further comprising a moveable frame mounted on the running rails so as to be moveable toward and away from the uncoiling means, the bottom rolls of the uncoiling means being mounted on the moveable frame.

* * * * *